United States Patent [19]

Haase

[11] Patent Number: 4,715,088

[45] Date of Patent: Dec. 29, 1987

[54] VACUUM CLEANER ATTACHMENT

[76] Inventor: Gerald A. Haase, 1005 Country Club Rd., Lake Oswego, Oreg. 97034

[21] Appl. No.: 901,706

[22] Filed: Aug. 29, 1986

[51] Int. Cl.[4] ..... A47L 9/02

[52] U.S. Cl. ..... 15/415 A; 15/395; 15/414

[58] Field of Search ..... 15/415 R, 415 A, 393, 15/398, 416, 414, 395, 396

[56] References Cited

U.S. PATENT DOCUMENTS

| | | | |
|---|---|---|---|
| 986,245 | 3/1911 | Thurman | 15/415 R |
| 1,431,943 | 10/1922 | Gee | 15/415 R X |
| 1,831,328 | 11/1931 | Thamm | 15/395 |
| 2,028,688 | 1/1936 | Rugg et al. | 15/396 X |
| 2,198,339 | 4/1940 | Hamilton | 15/395 |
| 2,243,120 | 5/1941 | Pollitt | 15/395 |
| 2,606,338 | 8/1952 | De Lorenzo | 15/395 |

*Primary Examiner*—Chris K. Moore
*Attorney, Agent, or Firm*—Olson and Olson

[57] ABSTRACT

A vacuum cleaner attachment nozzle especially configured for cleaning confirmed areas beneath and behind major appliances and furniture and the like comprises a narrow and thin, longitudinally elongated, hollow body member, preferably approximately 3 feet in length, and having a vacuum cleaner hose fitting at one end, the opposite end of the body being closed, and suction openings being provided through the lateral side walls of the hollow body member, preferably along the entire length of the working portion of the attachment body, whereby cleaning air flows laterally through the suction openings in a plane substantially parallel to a surface being vacuumed as the attachment nozzle is moved from side to side during vacuuming.

4 Claims, 4 Drawing Figures

VACUUM CLEANER ATTACHMENT

BACKGROUND OF THE INVENTION

This invention relates to vacuum cleaner attachments, and more particularly to a novel attachment especially configured for use in narrow, confined areas, particularly beneath and behind major appliances and furniture.

Various vacuum cleaner attachments have been provided heretofore which can be used under furniture, and are somewhat similar in basic appearance to the present invention. U.S. Pat. Nos. 2,101,222; 4,476,607; 4,506,406 and 4,332,051 are illustrative.

In U.S. Pat. No. 2,101,222, McCracken discloses an elongated, narrow and thin conduit 5 provided with a pair of small suction ports 8 adjacent the releasably closed front end of the conduit, the ports specifically disposed on the bottom side of the conduit between a pair of laterally spaced apart, longitudinally elongated brushes 13 arranged to scrape the surface to be vacuumed. Suction therefore is accomplished exclusively through the front bottom side of the nozzle, this being made possible by the brushes 13 which support the bottom side of the nozzle above the surface of a floor, whereby cleaning air flow is afforded through the suction ports.

U.S. Pat. No. 4,476,607 discloses the same general nozzle construction as in McCracken, but with a plurality of suction slots 28 provided along the length of the bottom side of a short nozzle 20.

The remaining patents are of incidental interest only, as they provide nozzles specifically configured to accomplish other purposes such as cleaning venetian blinds, etc.

SUMMARY OF THE INVENTION

In its basic concept, this invention provides a vacuum cleaner attachment nozzle configured with a longitudinally elongated slender and hollow body, closed at one end and provided with a hose attachment fitting at the opposite end, the body including suction openings only through its side walls, preferably along the majority of the length of the hollow body.

It is by virtue of the foregoing basic concept that the principal objective of this invention is achieved; namely, the provision of a nozzle attachment for vacuum cleaners that is specifically configured to function in hard to reach places, such as underneath and behind furniture and major appliances, and furthermore is configured to provide only lateral suction for efficient vacuum cleaning action in such confined areas.

Another object of this invention is the provision of a vacuum cleaner attachment nozzle which may be of various different cross sectional configurations as may be needed for desired functions.

A further object of this invention is the provision of a vacuum cleaner attachment nozzle of the class described which specifically provides suction openings through the lateral sides of the body only, and said openings may be configured with greater or smaller area from one end of the body to the other in order to balance the suction along the length of the attachment for maximum cleaning efficiency.

A still further object of this invention is the provision of a vacuum cleaner attachment of the class described which is of simplified construction for economical manufacture.

The foregoing and other objects and advantages of this invention will appear from the following detailed description taken in connection with the accompanying drawings of preferred embodiments.

DESCRIPTION OF THE PREFERRED EMBODIMENTS

Figure 1:
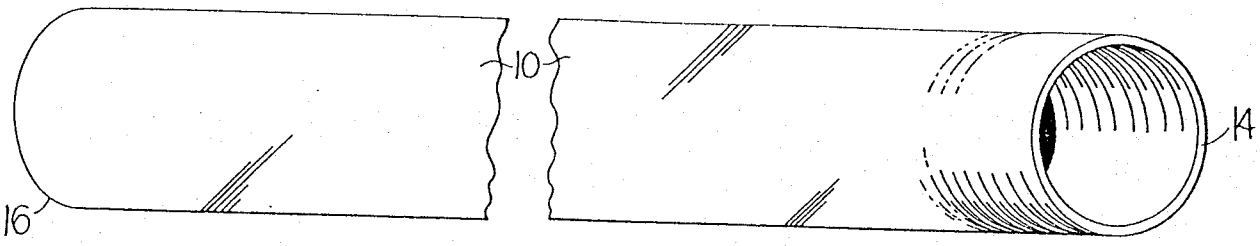
FIG. 1 is a foreshortened plan view of one configuration of a vacuum cleaner attachment embodying the features of this invention.
Figure 2:
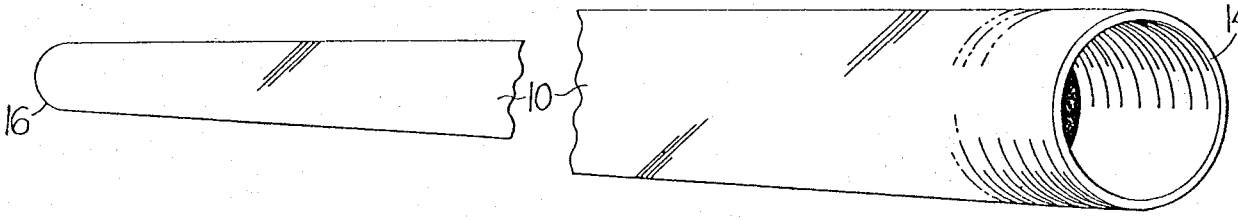
FIG. 2 is a foreshortened plan view of another configuration of a vacuum cleaner attachment embodying the features of this invention.
Figure 3:
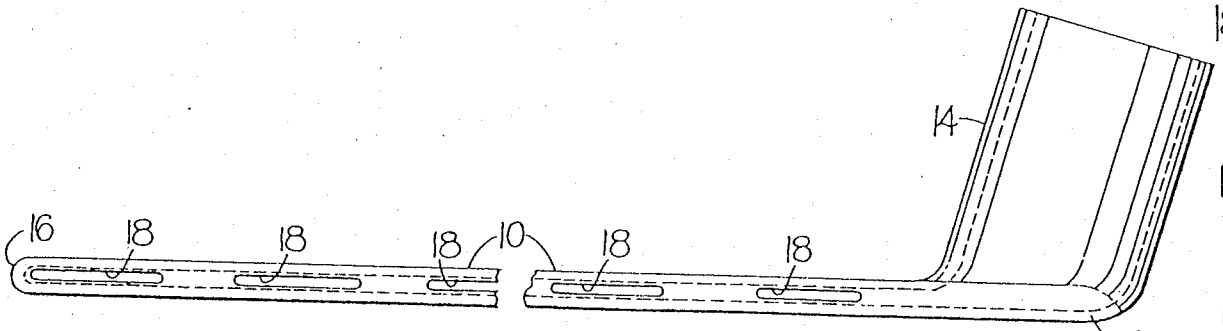
FIG. 3 is a foreshortened side elevation of a vacuum cleaner attachment as would be viewed from the bottom in either FIGS. 1 or 2 showing suction openings provided along the entire length of the side of the attachment.

Referring to the drawings, and particularly to FIG. 3 which illustrates the novel structural features of the present invention most clearly, it will be seen that the vacuum cleaner attachment of this invention includes a longitudinally elongated slender hollow body member 10 preferably approximating three feet, more or less, in length. The body member is configured with one end 12 mounting a fitting 14 for connection to a vacuum cleaner hose (not shown) and an opposite end 16 which is closed. The body may be uniform in width, as seen in the plan view of the embodiment of FIG. 1, or may taper partially or fully in width from one end to the other as shown in the embodiment of FIG. 2.

As seen in FIG. 3, the working portion of the body is preferably uniform in thickness, or height, in order to be able to enter beneath furniture and major appliances where clearance room is extremely limited. Suction openings 18 are provided through one or preferably both lateral side walls 10' of the body 10, the openings communicating the hollow interior of the body with the outside. FIG. 3 illustrates that a plurality of openings 18 are provided preferably along substantially the entire length of the working portion of the attachment body, thereby allowing for cleaning action along the entire length of the attachment.

Although FIG. 3 shows a plurality of small openings 18, it is to be understood that an appropriate number of larger or more elongated openings could alternatively be provided if so desired. Also, FIG. 3 shows that the openings are configured somewhat smaller in length progressively towards the end 12 mounting the vacuum cleaner hose attachment fitting 14. Since this end is nearest the source of suction, it may be desirable to configure the openings in this manner in order to effectively "balance" the suction along the full length of the attachment, and hence make the cleaning action equal from one end of the body to the other. However, uniformly sized openings along one side or both sides may alternatively be provided if so desired.

The attachment of this invention is illustrated in the preferred embodiments as having a vacuum cleaner hose connection 14 configured to extend angularly upward from the attachment body 10. This construction is preferred in order to permit a user to stand upright while vacuuming the floor under a sofa, appliance or the like. However it will be understood by those skilled in the art that the hose fitting could alternatively be configured to extend at other angles and directions, or rearwardly, straight from the body in the same longitudinal plane if so desired or needed. Also, a swivel type hose connector (not shown) could be used which would permit the angular positioning of the attachment relative to the hose to be varied if so desired.

Figure 4:
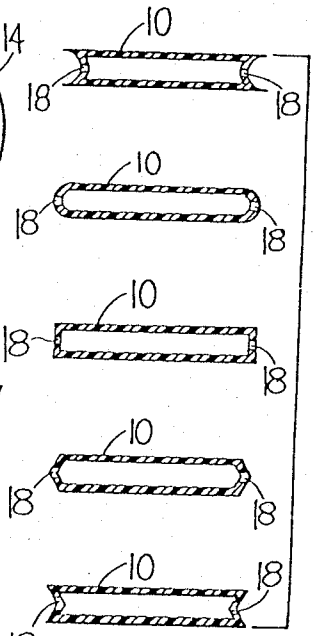
FIG. 4 is a plurality of cross sectional views illustrating various shapes of side walls for containing the plurality of suction openings.

FIG. 4 illustrates five alternative cross sectional configurations of the vacuum cleaner attachment of this invention. As shown, the body may be configured in a number of different ways in order to expose the suction openings 18 along the sides in a desired manner relative to a surface to be cleaned. For example, the side walls 10' of the body may be somewhat concave, that is curved or angled inwardly so that the suction openings are recessed inwardly from the outermost edges of the side walls, as shown in the top and bottom embodiments of FIG. 4. Alternatively, the side walls 10' may be configured straight, as in the center embodiment of FIG. 4, thus making the openings 18 flush with the planes of the body side walls. Alternatively, as shown in the second and fourth views of FIG. 4, the side walls 10' may be configured to be convex in cross section, in order to more significantly expose the openings 18 if so desired.

Accordingly, it is readily apparent that the attachment of this invention provides a unique vacuum cleaner accessory which is arranged and configured to access areas that typically are difficult to reach, and provides laterally directed suction through only the side walls of the attachment for cleaning floors, walls, etc., beneath and behind furniture, major appliances and other hard to move, low to the ground objects. Moreover, the attachment of this invention allows a user, by virtue of the specific construction of the attachment, to clean these areas while maintaining a confortable standing position as is typical in normal floor vacuuming.

The attachment of this invention benefits over the known art by not requiring structure such as brushes and the like to support the body above a floor surface so that air flow can be permitted through the openings, which heretofore have been downwardly directed. Moreover, since other support structures and the like are not needed to achieve cleaning action, the costs can be reduced significantly. Also, the present invention allows for suction simultaneously in two directions parallel to a surface to be cleaned, whereas the prior art floor cleaning devices draw dirt and dust from only one vertical direction directly beneath the body of the attachment.

The operation of the vacuum cleaner attachment once connected to a vacuum cleaner hose is as follows: The thin working portion of the body of the attachment forwardly of the hose fitting 14 is slid beneath a sofa or refrigerator or the like, and the body is moved laterally over the floor surface, its bottom wall sliding on the floor surface. As the attachment moves in each direction, debris is drawn through the suction openings and into the vacuum cleaner. As the device is moved in one direction, dust and dirt are drawn directly into the suction openings facing the direction of movement. The bottom wall of the body moves over the surface and somewhat agitates carpet fibers and the like to release debris that might be clinging thereto, and the loosened debris is drawn into the body through the suction openings on the trailing side of the attachment body. A return sweep of the attachment over the same area duplicates the above cleaning action, but in the opposite direction. Therefore it is clear that cleaning under major appliances and furniture involves simply inserting the body under the object, and moving it sideways over the floor surface preferably in each direction. Walls, ceilings and the like are obviously cleaned in the same manner.

It will be apparent to those skilled in the art that various changes, other than those already described above, may be made in the size, shape, type, number and arrangement of parts described hereinbefore without departing from the spirit of this invention and the scope of the appended claims.

Having thus described my invention, and the manner in which it may be used, I claim:

1. A vacuum cleaner attachment, comprising:

(a) a longitudinally elongated hollow body member having substantially flat, closed top and bottom walls, and a pair of opposite lateral side walls, the body member having a closed forward longitudinal end and an open opposite longitudinal end mounting a vacuum cleaner hose fitting, and (b) suction openings through only at least one lateral side wall at spaced intervals along the body member, (c) the body member configured with a slender profile for access to the limited vertical space under appliances and furniture, said flat bottom wall configured to be disposed adjacent a surface to be cleaned for movement of the attachment therealong, whereby said suction openings are disposed to permit air flow substantially only parallel to the surface to be cleaned.

2. The vacuum cleaner attachment of claim 1 wherein suction openings are provided on both lateral side walls of the body member.

3. A vacuum cleaner attachment, comprising:

(a) a longitudinally elongated, hollow body member having a top, bottom and lateral side walls, the body member having a closed, forward longitudinal end and an open opposite longitudinal end mounting a vacuum cleaner hose fitting, and (b) suction openings through at least one lateral side wall, the length of said openings increasing progressively from the hose fitting end toward the closed forward end of the body member, (c) the bottom wall configured to be disposed adjacent a surface for movement of the attachment therealong, whereby the suction openings are disposed to permit air flow substantially parallel to the surface.

4. The vacuum cleaner attachment of claim 1 wherein the body member is configured to taper in width from the hose fitting end to narrower width at the closed forward end.

* * * * *